United States Patent [19]

Glovak et al.

[11] 4,151,997

[45] May 1, 1979

[54] HYDROPLANING DISC

[75] Inventors: Danny W. Glovak; Allan W. Buyze, both of Hamtramck, Mich.

[73] Assignee: A. D. Design Services, Inc., Hamtramck, Mich.

[21] Appl. No.: 739,837

[22] Filed: Nov. 8, 1976

[51] Int. Cl.[2] ..... A63B 65/10; A63B 67/06

[52] U.S. Cl. ..... 273/106 B

[58] Field of Search ..... 46/74 D, 1 R; 273/106 B, 105.4, 33; 272/107

[56] References Cited

U.S. PATENT DOCUMENTS

| | | | |
|---|---|---|---|
| 1,815,520 | 7/1931 | McLeod | 273/33 |
| 2,640,699 | 6/1953 | Garbo | 273/106 B |
| 3,359,678 | 12/1967 | Headrick | 46/74 D |
| 3,399,255 | 8/1968 | Moehlman et al. | 273/105.4 |
| 3,544,113 | 12/1970 | Hand | 272/106 B |
| 3,613,295 | 10/1971 | Everett | 273/106 B |
| 3,840,232 | 10/1974 | Ludwig et al. | 273/105.4 |
| 3,954,263 | 5/1976 | Whelan et al. | 273/33 |

FOREIGN PATENT DOCUMENTS

| | | | |
|---|---|---|---|
| 181801 | 4/1955 | Austria | 273/106 B |
| 2319919 | 10/1974 | Fed. Rep. of Germany | 272/107 |

*Primary Examiner*—F. Barry Shay

*Attorney, Agent, or Firm*—Danny W. Glovak; Allan W. Buyze

[57] ABSTRACT

An aerodynamic and hydromechanical hydroplaning disc with a solid unitary body comprised of aggregated material. The disc is heavier than the water it displaces and non-floating. A series of longitudinally oriented (i.e., meridionally oriented, or north-south) discontinuities are provided only on the extreme latitudinal periphery of the rim adjacent to the top and bottom surfaces of the disc. Said discontinuities: exert a greater interfering effect on the airflow and waterflow around the circumference than over the top and under the bottom surfaces; create a turbulent, separated and unseparated, peripheral boundary layer in air and water; reduce air resistance and water resistance; increase range, frequency of skips, and dynamic stability. Also, there is provided a granular texture on the bottom and circumferential surfaces of the disc which results in a more sure grip and improved hydroplaning stability (i.e., the ability of the disc to maintain a horizontal orientation while hydroplaning).

4 Claims, 9 Drawing Figures

HYDROPLANING DISC

SUMMARY OF THE INVENTION

The spirit and scope of this concept relates to implements having both aerodynamic and hydromechanical properties and, in particular, to an aerodynamic hydroplaning disc with a solid unitary body to be thrown through the air and to hydroplane over a body of water for use in hydroplaning disc games.

Webster's Unabridged International Dictionary defines a drake or drakestone as a skipping stone; a flat stone used in the game of ducks and drakes (i.e., in stone skipping games). The present invention is an extrapolation and improvement of the naturally occurring "skipping stone." With this new disc a very desirable quality is available to the individual thrower and to throwers in competition, namely, consistency. The infinite variability inherent in naturally occurring stones and the resulting infinite variability in aeroplaning and hydroplaning is eliminated. Thus, individual improvement can be measured and competition becomes meaningful in the game of ducks and drakes.

The configuration of this invention is such that it may be employed not only for a device of pleasure and sport, but also for conservation application, marine research, sea-going vehicles, navigational equipment, and military hardware. Primarily, however, the typical configuration of this invention pertains to a disposable hydroplaning disc. Each disc is intended to be used only once and in use is thrown away.

Since water ecology is a basic concern with the use of this invention, each disc would be composed of ecologically complimentary materials, for example, sand plus a water soluble organic binder. Because the natural materials used are common to the surrounding environment, upon decomposition the used disc would easily and naturally blend with its compatible environment. Conceivably, with the addition of selected chemicals, this hydroplaning disc would become an inviting and enjoyable means of achieving ecological improvement in local aquatic areas.

The entire surface of the disc has a uniform granular texture. This feature assures a positive grip even when the hand of the thrower is wet. Also, hydroplaning stability (i.e., the ability of the disc to correct itself to a horizontal orientation while hydroplaning) is significantly increased specifically due to said granular texture on the substantially flat bottom surface and the extreme periphery.

The elevational view of this invention reveals a shape that simultaneously combines an airfoil and a hydrofoil. This configuration provides beneficial aerodynamic advantages during the flight of the disc from its initial release to its first contact with the water. Similarly, hydroplaning advantages occur each time the disc skips from the surface of the water to become totally or partially airborne.

The longitudinally oriented discontinuities and transitional surfaces on the circumference — which hereafter shall be referred to as hydrofoils — produce an interfering effect on the airflow and the waterflow around the circumference of the disc and, depending on whether the disc is in the air or partially submerged, create a continuous and discontinuous turbulent boundary layer at the periphery. In hydrodynamics, this action is described as hydroplaning; in aerodynamics, aeroplaning.

In each case, water resistance and air resistance are reduced and dynamic stability is increased.

When the disc is thrown in a predetermined manner and direction, as described herein, with sufficient force and spin toward the surface of a body of water, it will skim and skip over the water surface. As the disc travels over the surface of a body of water, two directions of hydroplaning occur: one linear, one radial. Relative to the direction of travel (linear aspect) of the disc over a water surface, the whole disc functions as a hydroplane. Relative to the spin or rotation (radial aspect) of the disc over a water surface, the plurality of meridionally oriented hydrofoils at the periphery of the disc provide a rotational hydroplaning action.

The top and bottom of the implement are substantially flat; the rim is convex; the elevational view shows both an airfoil and a hydrofoil; and the plan view shape is primarily circular with slight circumferential disruptions, or hydrofoils. The series of longitudinally oriented, evenly spaced hydrofoils on the rim of the disc are such that the maximum disruption occurs along the widest line of latitude (i.e., at the outermost circumference). Each hydrofoil progressively diminishes as it extends toward the center axis of the disc and is terminated on the flat surfaces. Each peripheral hydrofoil is bilaterally symmetrical with respect to a longitudinally oriented plane passing through its center. Therefore, clockwise or counter-clockwise rotation (i.e., right or left hand operation) of the disc will produce identical (i.e., mirror image) results — given the same flat surface is up in each case. The peripheral hydrofoils conserve linear energy by reducing rotational water resistance and provide dynamic stability (i.e., a self-levelling quality).

Figure 5:
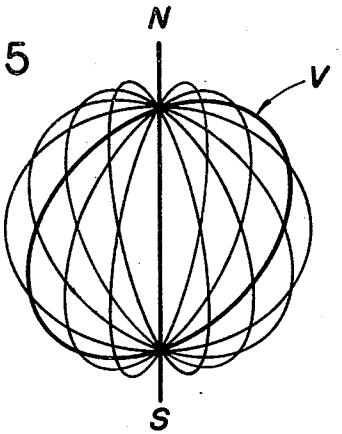
FIG. 5 is a diagramatic and assists in the definition of longitudinal (i.e., meridional) lines by indicating their direction relative to a center axis N-S.

Referring first to FIG. 5, for the purpose of defining the terms to be used in the following preferred embodiment, the orientation of lines of longitude are shown relative to a central vertical axis N-S. Said lines lie in planes passing through said axis and follow the contour of a sphere. One such line V is indicated in FIG. 5 and is distinguished by its relative thickness from other similar lines of longitude. Although FIG. 5 illustrates the lines of longitude of a sphere, the purpose of this diagram is that its concept be applied to similarly oriented contour lines and planes of the preferred embodiment.

Figure 6:
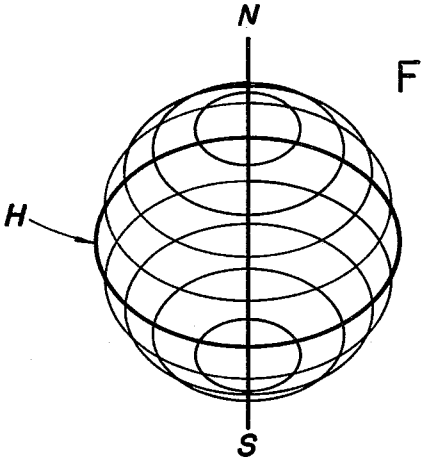
FIG. 6 is a diagramatic and assists in the definition of latitudinal lines by indicating their direction relative to a center axis N-S.

FIG. 6 pictures diagramatically the orientation of lines of latitude relative to a central vertical axis N-S. Said lines lie in planes perpendicular to said axis and follow the contour of a sphere. One such line H is indicated in FIG. 6 and is distinguished by its relative thickness from other lines of latitude. Although FIG. 6 illustrates the lines of latitude of a sphere, the purpose of this diagram is that its concept be applied to similarly oriented contour lines and planes of the preferred embodiment.

Figure 7:
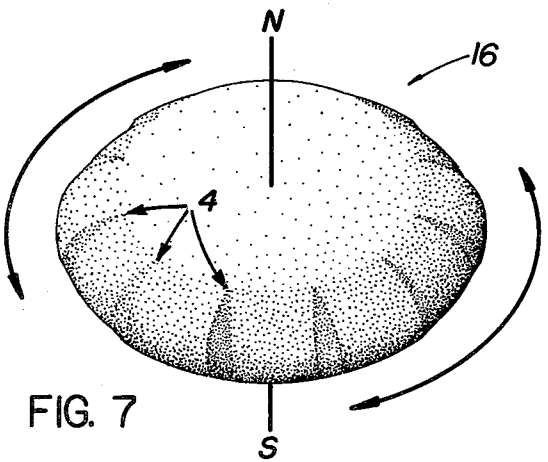
FIG. 7 is a top perspective view.

FIG. 7 shows the top of the hydroplaning disc 16 in perspective. Perpendicular to the top and bottom flat surfaces of the disc is a central axis N-S which provides correlation with the lines of longitude as shown in FIG. 5 and the lines of latitude as shown in FIG. 6.

Figure 8:
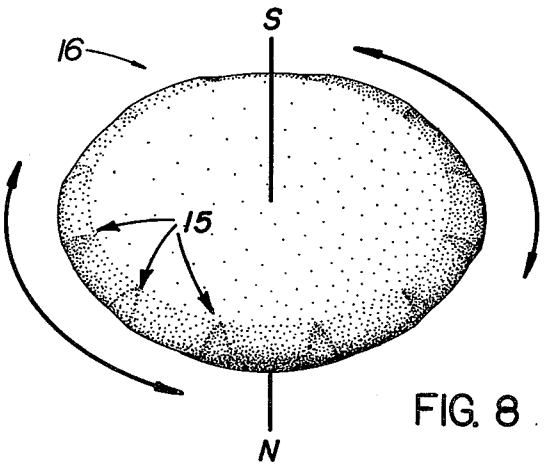
FIG. 8 is a bottom perspective view.

FIG. 8 shows the bottom of the hydroplaning disc 16 in perspective. Perpendicular to the top and bottom flat surfaces of the disc, there is a central axis N-S which provides correlation with the lines of longitude as shown in FIG. 5 and the lines of latitude as shown in FIG. 6.

Figure 1:
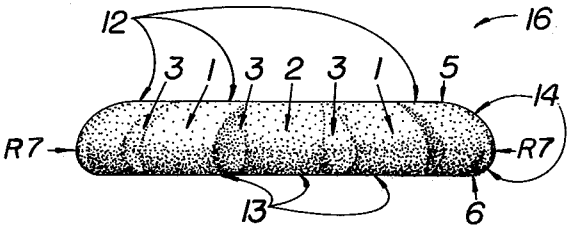
FIG. 1 is an elevational view.

Referring now to FIG. 1, there is shown an elevational view of the hydroplaning disc 16 of this invention. FIG. 1 reveals a profile which combines an airfoil and a hydrofoil. The substantially flat top surface 12 is smaller in area than the substantially flat bottom surface 13. Connecting the top and bottom surfaces is a primarily circular rim 14 which is everywhere convex along any of its lines of longitude as shown in FIG. 5. From the extreme peripheral boundary R7, the rim 14 extends upwardly to a point of juncture 5 with the top flat surface 12 forming an upper portion which is convex overall when viewed in elevation. Similarly, from the extreme peripheral boundary R7, the rim extends downwardly to a point of juncture 6 with the bottom flat surface 13 forming a lower portion which is convex overall when viewed in elevation.

Figure 4:
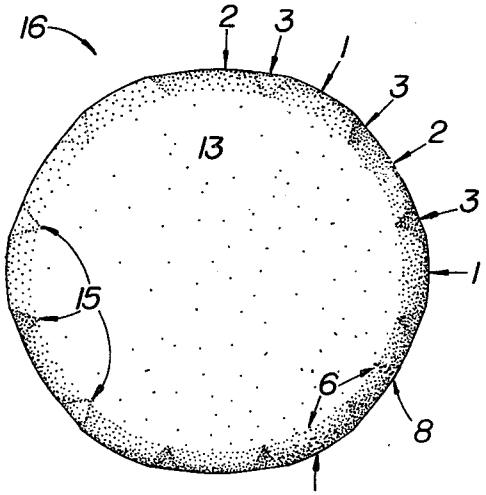
FIG. 4 is a bottom plan view.
Figure 3:
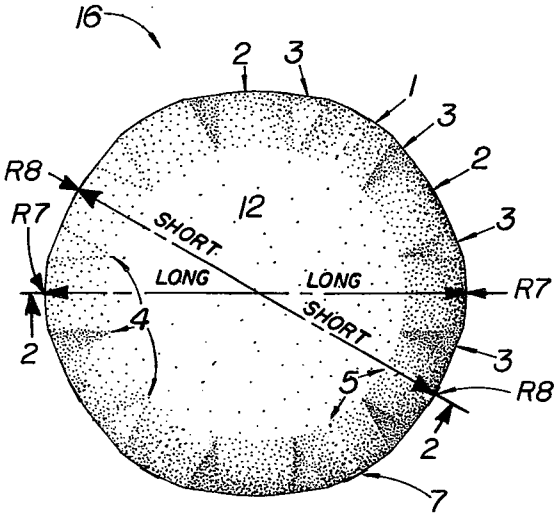
FIG. 3 is a top plan view.

FIGS. 3 and 4 show plan views of the convex top portion and the convex bottom portion of the hydroplaning disc 16. FIGS. 3 and 4 also show that the implement 16 is an irregular circle, the circumferential curvature of which is slightly interrupted by a plurality of regularly spaced subtle discontinuities 1, 2, and 3. The discontinuities 1, 2, and 3 are formed by a radius which subtly and regularly changes in length as it circumscribes the disc at its widest line of latitude, that is, its extreme latitudinal periphery. The outermost discontinuities 1 and the innermost discontinuities 2 are connected by a transitional surface 3 which appears as a small triangular shape both in the top and bottom views; surface 3 widens as it extends outwardly toward the circumference of the disc. Transitional surface 3 terminates inwardly to zero at a point of juncture 4 with the top flat surface 12. Again surface 3 terminates inwardly to zero at a point of juncture 15 with the bottom flat surface 13.

All discontinuities 1, 2, and 3 are longitudinally oriented; they are most pronounced at the periphery, progressively diminish toward, and are terminated on the top 12 and bottom flat surfaces of the disc. The sequence 3, 1, 3 of adjacent surfaces comprises what shall be referred to herein as a peripheral hydrofoil. There are a plurality of such hydrofoils at the extreme latitudinal periphery of the disc. They are equally spaced, being separated by the sequence 3, 2, 3 of adjacent surfaces. The sequence 3, 2, 3 forms a peripheral depression which connects the peripheral hydrofoils and shares the transitional surface 3.

Each peripheral hydrofoil is longitudinally oriented and bilaterally symmetrical with respect to a longitudinally oriented plane passing through the center of the hydrofoil. Therefore, relative to the clockwise or counterclockwise rotation of the disc 16 about its central axis N-S (see FIGS. 7 and 8), each peripheral hydrofoil provides for identical (i.e., mirror image) results for right or left hand operation.

Peripheral hydrofoils of this invention contribute to the stability, range, and biotechnology of the disc. In regard to the skipping and skimming of the disc over the surface of a body of water, especially during high speed operation, the peripheral hydrofoils cause the disc to lift out of the water and rotationally hydroplane at the periphery. In this manner, the amount of the disc actually touching the water is reduced; correspondingly, hydrodynamic drag (i.e., water resistance) is reduced and range and the number of skips is increased.

As suggested by the shading of FIG. 1, FIG. 3, FIG. 4, FIG. 7, and FIG. 8, the entire surface of the hydroplaning disc has a uniform texture approximately equivalent to that of #80 grit, or finer, sandpaper. Specifically, said texture on the bottom 13 and on the rim 14 has been found to significantly contribute to hydroplaning stability (i.e., a self-levelling quality) as the disc skims the surface of a body of water. Also, the sandpaper-like texture of the rim 14 together with the peripheral hydrofoils and depressions provide for a positive grip even when the hand is wet. Thus poor throws due to poor biotechnology are minimized; moreover, even with a poor throw, the probability of good water skipping results is maximized.

Figure 2:
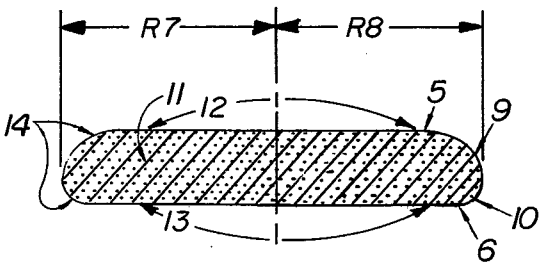
FIG. 2A is a sectional view along lines 2—2 of FIG. 3.
FIG. 2B is a fragment showing the edge of the cross sectional contour along line R7—R7 with the cross sectional contour along line R8—R8 superimposed thereon.

FIG. 2 shows a sectional view along lines 2—2 of FIG. 3 and reveals that the implement is a solid unitary body consisting of a uniformly distributed material, for example, sand, which occupies the entire volume of the disc. Thus, the disc is significantly heavier than an equal volume of water and is non-floating. This weight factor has been found beneficial to the overall performance of the disc because a heavier-than-water disc contains more potential energy than a lighter-than-water disc. Therefore, there is increased ability of the disc to maintain its inertia during hydroplaning. The entire rim 14 refers to and includes all peripheral hydrofoils and peripheral depressions.

The outermost convex rim portion at R7 (i.e., the central, longitudinal contour of a peripheral hydrofoil) is farther from the central axis than the innermost convex rim portion at R8 (i.e., the central, longitudinal contour of a peripheral depression). Both rim sections have the same contour and orientation relative to the top and bottom flat surfaces and central axis N-S (see FIGS. 5-8), the only difference being their distance from said axis. Therefore, as pictured in FIG. 2, the amount of latitudinal disruption is the same through any point on the convex rim: for example, the latitudinal offset between the rim at R7 and the rim at R8 through a point 9 is equal to that offset through another point 10. There is a point 5 at which the rim joins the top flat surface 12 and a similar point 6 at which the rim joins the bottom flat surface 13. From points 5 and 6 inwardly, toward the center axis N-S, there are no surface disruptions as per the scope of this invention.

The implement 16 is intended to be gripped in one hand, the rim 14 being held between the first finger and the thumb with the thumb side of the middle finger curving under the disc and supporting the bottom surface. Alternatively, the first finger is along the rim 14 with the thumb on the top surface and the thumb side of the middle finger curving under and supporting the bottom surface. The throwing release should be such that spin about the N-S axis is imparted to the disc by allowing it to quickly roll off the first finger. The disc is thrown in a manner such that, upon release, the latitudinal planes are parallel with, close to, and speeding toward the surface of a body of water. Beneficial aerodynamic and hydromechanical properties are displayed as the disc aeroplanes and hydroplanes, alternately skipping over, skimming on, and flittering across the surface of a body of water.

While a preferred embodiment of the invention has been described using specific terms, such description is for illustrative purposes only, and it is to be understood that changes and variations may be made without departing from the spirit or scope of the following claims.

What is claimed is:

1. Aerodynamic and hydromechanical hydroplaning disc comprising;

(1) a primarily circular and solid unitary body having a substantially flat top surface parallel to a substantially flat bottom surface enclosing the bulk of the central portion of the disc, such that the central body portion has a greater thickness than the rim;

(2) a rim joining the top and bottom surfaces such that said rim is formed by a predetermined convex contour, which contour subtly and regularly changes its distance from its central axis as said contour circumscribes the disc creating periodic latitudinal disruptions at the extreme latitudinal periphery;

(3) said rim having a plan view boundary defined by subtle discontinuities formed by a radius which subtly and regularly changes its length, as it circumscribes the disc at its widest line of latitude, creating said periodic disruptions;

(4) said rim having its plurality of disruptions evenly spaced such that all outermost, longitudinally oriented contours thereof have the same contour and orientation as all innermost longitudinally oriented contours thereof; and (5) said rim having a surface of curvature which extends downwardly and upwardly from the extreme latitudinal boundary to the respective ones of said flat surfaces, creating for said disc an overall convex bottom and an overall convex top surface respectively; and (6) airflow and waterflow interfering means located on the extremity of said rim being longitudinally oriented, said interfering means extending from said boundary upwardly and downwardly, diminishing toward, and terminating entirely at the juncture with said top and bottom surfaces, respectively.

2. An implement according to claim 1, being heavier than the water it displaces, non-floating, and water soluble.

3. An implement according to claim 1, having a uniform granular texture over at least the bottom surface.

4. An aerodynamic and hydromechanical hydroplaning disc according to claim 1, wherein said outermost longitudinally oriented contours are connected by a plurality of extremely located transitional surfaces (3), one peripheral portion (3,1,3) of said disc from one transitional surface to the next adjacent transitional surface constituting a first hydrofoil, a second hydrofoil being spaced from said first hydrofoil by a peripheral portion (3,2,3) of said disc between said next adjacent transitional surface and a third transitional surface next adjacent to the latter, and so on throughout the periphery of said disc, said hydrofoils being longitudinally oriented, evenly spaced, with respect to each other and exhibiting bilateral symmetry with respect to a longitudinally oriented plane passing through the center of each hydrofoil.

* * * * *